US011326855B1

(12) United States Patent
Bradford

(10) Patent No.: US 11,326,855 B1
(45) Date of Patent: May 10, 2022

(54) TRIPLE LAYER HYBRID HOLSTER FOR A HANDGUN

(71) Applicant: Richard N. Bradford, Lake Mary, FL (US)

(72) Inventor: Richard N. Bradford, Lake Mary, FL (US)

( * ) Notice: Subject to any disclaimer, the term of this patent is extended or adjusted under 35 U.S.C. 154(b) by 0 days.

(21) Appl. No.: 15/676,133

(22) Filed: Aug. 14, 2017

(51) Int. Cl.
*F41C 33/02* (2006.01)
*F41C 33/04* (2006.01)

(52) U.S. Cl.
CPC ..... *F41C 33/0236* (2013.01); *F41C 33/041* (2013.01)

(58) Field of Classification Search
CPC ..... F41C 33/0236; F41C 33/041
See application file for complete search history.

(56) References Cited

U.S. PATENT DOCUMENTS 4,483,501 A * 11/1984 Eddy ..... F41C 33/0209 224/198
5,465,429 A * 11/1995 Rogers ..... F41C 33/0209 2/300
7,258,259 B1 * 8/2007 Owens ..... A45F 5/02 224/192
2006/0219743 A1 * 10/2006 Gallagher ..... A45F 5/02 224/192
2013/0112722 A1 * 5/2013 Detry ..... F41C 33/0236 224/243
2015/0362284 A1 * 12/2015 Mileshko ..... F41C 33/0227 224/243
2016/0153746 A1 * 6/2016 Higgins ..... F41C 33/0209 5/503.1
2016/0216065 A1 * 7/2016 Tedder ..... F41C 33/041
2017/0227324 A1 * 8/2017 Metayer ..... F41C 33/0209
2018/0051969 A1 * 2/2018 Badr ..... F42B 39/02

* cited by examiner

*Primary Examiner* — Derek J Battisti
(74) *Attorney, Agent, or Firm* — Terry M. Sanks, Esq.; Beusse Sanks, PLLC

(57) ABSTRACT

A triple layer hybrid holster for a handgun adapted to be worn inside the waistband of a user comprising an outer layer formed of a shape-retentive moldable plastic material shaped to fit snugly against a side of a selected size and model of handgun and having a section that protrudes into a trigger guard area of the handgun. The holster further has a generally flat middle layer formed of a shape-retentive moldable plastic material configured to fit against an opposite side of the handgun for pressing the handgun into engagement with the outer layer. A user protective inner layer is attached in abutting relationship to an outer surface of the middle layer and is formed of a material having a generally smooth surface for contacting an adjacent skin surface of a user when the holster is worn inside the user's waistband.

8 Claims, 4 Drawing Sheets

TRIPLE LAYER HYBRID HOLSTER FOR A HANDGUN

BACKGROUND OF THE INVENTION

The present invention relates to handgun holsters and, more particularly, to an inside the waistband (IWB) handgun holster having at least three layers with two of the layers being generally rigid and adapted for compressively securing a handgun.

IWB handgun holsters are generally formed of a rigid plastic material such as Kydex. The material is commonly molded or vacuum formed to fit snuggly about the handgun so as to minimize the chances of the handgun inadvertently falling out of the holster. In many instances, the material is configured so that there is at least some portion of the material protruding into the trigger guard area of the handgun. The amount of protrusion of the material is limited since the material has to flex to allow the handgun to be withdrawn from the holster. In this type of holster in which an inner and outer layer of plastic material form a pocket for receiving the handgun, the inner rigid layer is in contact with the user and is tightly forced into engagement with the user by the user's waistband or belt. This direct contact with the user, either directly on the skin of the user or through a thin cloth layer such as an undershirt, is generally uncomfortable and hot.

In order to overcome the uncomfortable feeling associated with the use of a rigid plastic material in direct contact with a user, some holster manufacturers have been producing a hybrid holster. The hybrid holster uses an outer layer of rigid plastic material such as Kydex that is formed to fit a particular type of handgun and an inner leather layer that is attached to the outer layer. The inner leather layer is in contact with the user and is generally shaped to be more comfortable. While leather does not overcome the heat issue, it does provide a fit without sharp edges.

Applicant has found that the hybrid holster suffers from a different problem. When new, the leather inner layer is relatively stiff and is somewhat shaped to force the handgun into engagement with the outer plastic layer. However, as the leathers ages and absorbs perspiration from contact with the user, it assumes a more comfortable fit against the user while losing the stiffness and shape that forced the handgun into compressive contact with the outer layer. As a result, the handgun becomes looser in the holster and is not tightly restrained. The handgun can then fall from the holster if the holster is tipped or jarred sharply. A falling handgun landing on any hard surface can not only damage the handgun but could cause an undesirable discharge of the handgun.

SUMMARY OF THE INVENTION

The present invention is directed to a new type of hybrid handgun holster for inside the waistband use that avoids the problem of loosening associated with the prior art hybrid holster. In this invention, the IWB holster is constructed of three separate layers. Two of the layers serve to form a pocket for holding a handgun while the third layer provides a more comfortable surface for contact with the holster user. In an exemplary form, the holster can be described as a triple layer hybrid holster for a handgun adapted to be worn inside the waistband of a user. The holster has an outer layer formed of a shape-retentive moldable plastic material such as Kydex that is shaped to fit snugly against one side surface of a selected size and model of handgun and includes a section that protrudes into a trigger guard area of the handgun. A middle layer of the holster is formed of a shape-retentive moldable plastic material such as Kydex that is configured to fit against an opposite side of the handgun for pressing the handgun into engagement with the outer layer. An inner layer is attached in abutting relationship to an outer surface of the middle layer. The inner layer is formed of a material that that is more comfortable when in contact with a user and has a generally smooth surface without the sharp edges and bumps that are characteristic of the hard plastic material that is in contact with the surfaces of the handgun. This arrangement of three cooperating layers provides the comfort of a conventional hybrid holster while regaining the restraint that is provided by a non-hybrid holster.

BRIEF DESCRIPTION OF THE DRAWINGS

For a better understanding of the present invention, reference may be had to the following detailed description taken in conjunction with the accompanying drawings in which.

DETAILED DESCRIPTION

Figure 1:
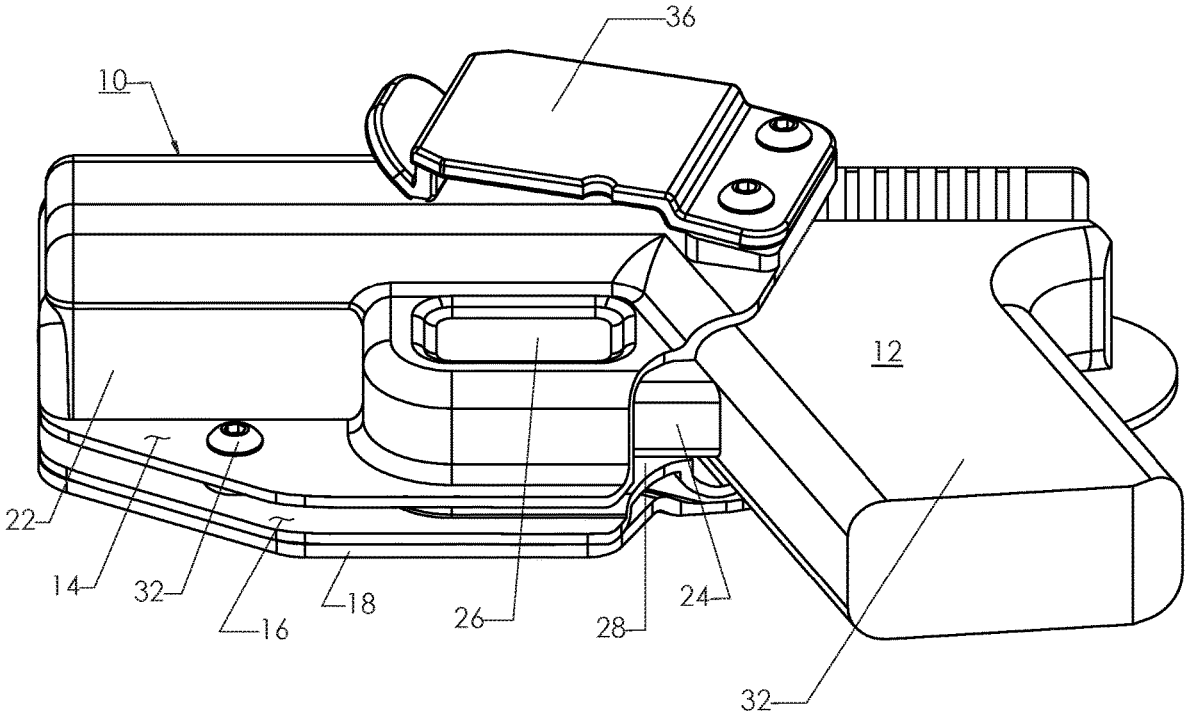
FIG. 1 is a perspective view of one form of a holster in accordance with the present invention taken from a side and bottom of the holster viewpoint.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Referring to the drawings in general, FIG. 1 represents an illustrative embodiment of a preferred form of the present inventive handgun holster 10 shown in a perspective view with a handgun 12 inserted in the holster. The holster 10 includes an outer layer 14, a middle layer 16 and an inner layer 18. The holster 10 is intended for carry inside the waistband (IWB) of a user and the term "outer layer" refers to the layer that would be facing away from the user while the term "inner layer" refers to the layer that would be in contact with the user. The inner layer 18 is desirably made of leather although other forms of material that have similar characteristics as leather could be used. For example, woven polyester fabrics could be used to construct the inner layer 18. The purpose of the inner layer 18 is to provide a comfort layer in contact with the user, whether directly on the user's skin or if separated by a thin clothing layer. Accordingly, there are various materials having characteristics of stiffness and comfort that could be substituted for leather.

The outer layer 14 in the illustrated preferred embodiment provides primary support for the handgun 12 and is formed of a molded polymer (plastic material) that has good shape retention characteristics such as the polymer marketed under the trademark Kydex and generally distributed in the form of thermoplastic sheets. In a typical holster formed from Kydex® thermoplastic, the sheet material is molded such that the handgun is equally supported by opposing layers of plastic. In one type of holster, the sheet material is folded about the handgun in the form of a taco shell while in another type, two separate layers are formed and joined together along their respective edges. With either type, the two opposing layers are molded to fit a particular size and shape of handgun and to support the handgun equally from both sides. As a result, for an IWB holster, the layer that would be in contact with a user has a number of irregular shapes and protruding edges that make carrying the holster uncomfortable. Hybrid holsters address the comfort issue with IWB holsters but introduce a different problem. As the holster is used, the leather layer (or similar material) can deform such that the handgun is no longer firmly held in place in the holster and can fall out if the holster is tilted, such as by the user bending over at the waist.

The holster of FIG. 1 incorporates a middle layer 16 preferably molded of the same material as the outer layer 14, for example, Kydex® thermoplastic. This middle layer 16 is different from the layers used in the conventional holster in that the layer 16 is not molded to fit around or encompass the adjacent side and edges of the handgun 12. Instead, the layer 16 is molded to create a generally flat sheet fitting against the side of the handgun and having indentations that accept protrusions on the side of the handgun. Although such indentations can create projections on the reverse or outside surface of the inner layer, such projections can be machined to minimize the extent of any lump caused by the projection or can be removed leaving a hole in the layer 16 into which the handgun protrusion may fit. The inner layer 18 abuts against the outer surface of the middle layer 16 and has such resilient properties as to further minimize the extent of any projections so that a smooth surface is provided on an outer surface of the layer 18 for contact with the user.

Figure 2:
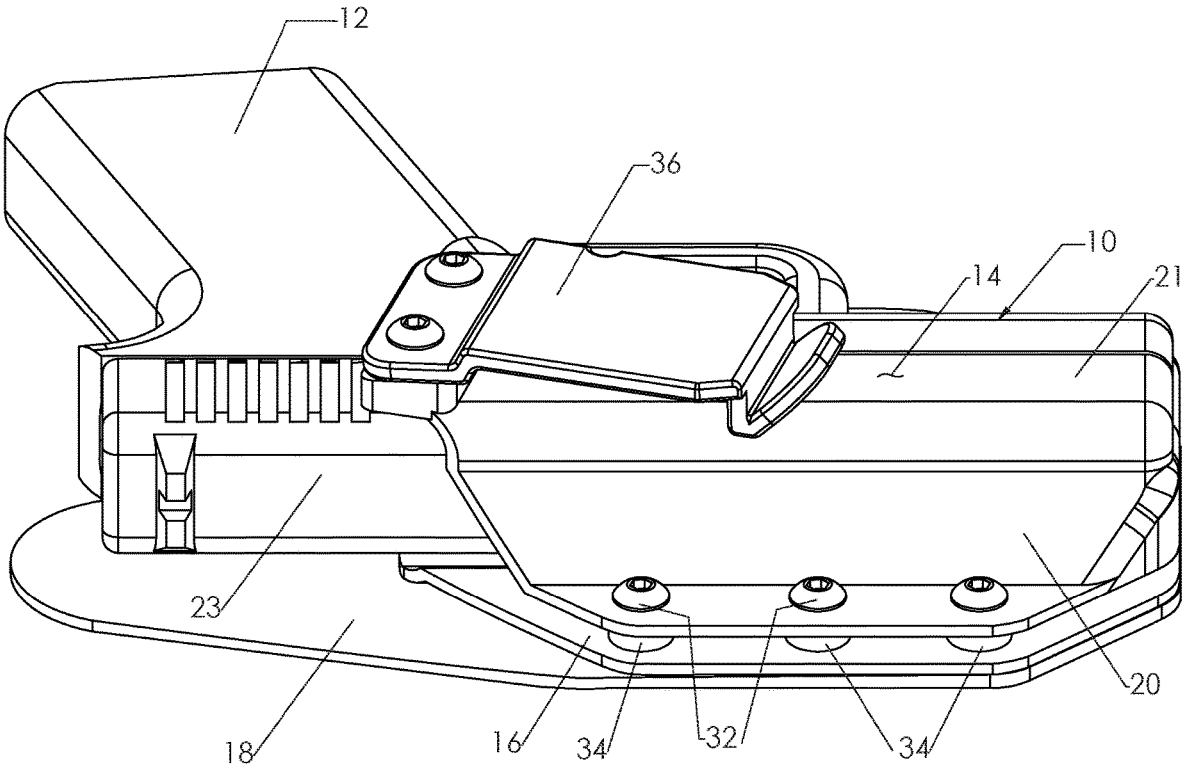
FIG. 2 is a perspective view of the holster of FIG. 1 taken from an opposite direction from FIG. 1.
Figure 4:
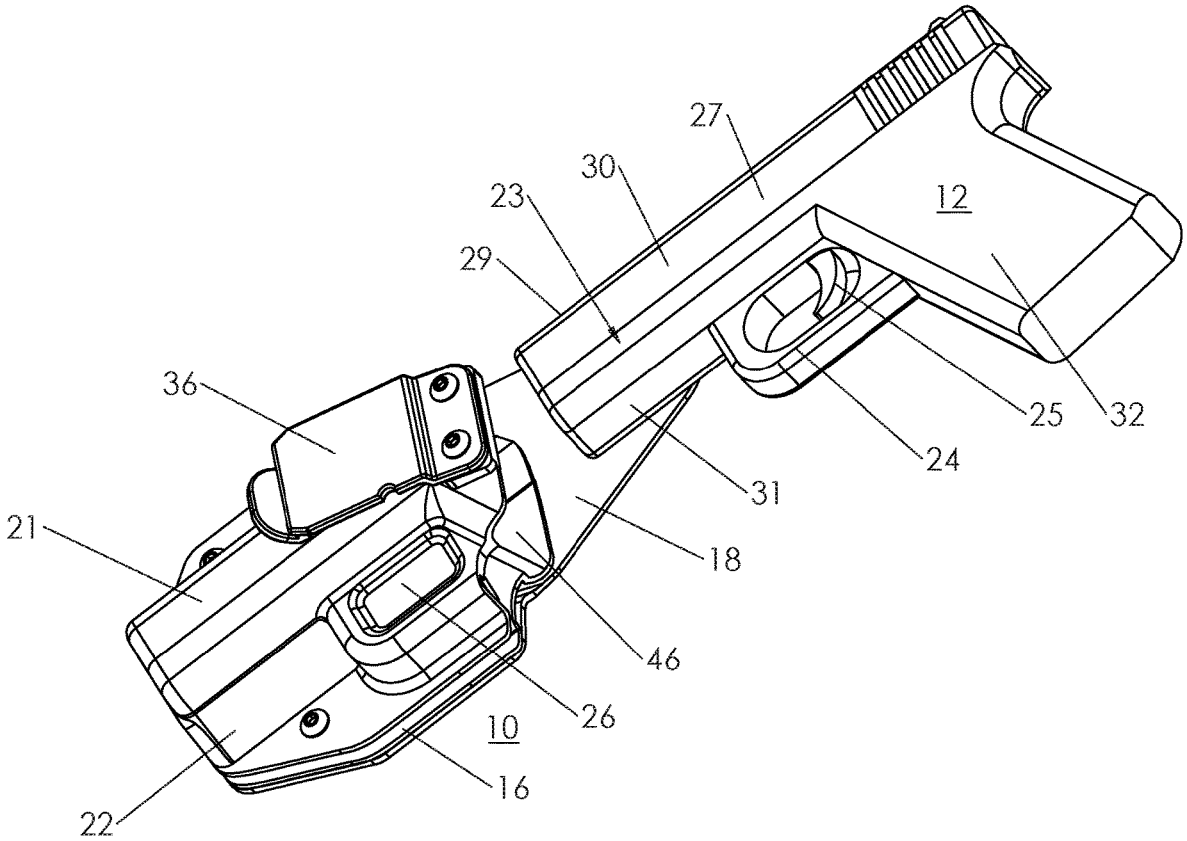
FIG. 4 is a perspective view of the holster of FIG. 1 with the handgun removed therefrom.

Considering FIG. 1 in conjunction with FIG. 2, it can be seen that the outer layer 14 is molded to fit a particular type, size and style of handgun 12 such that about eighty percent of the support for the handgun is derived from the outer layer. Turning briefly to FIG. 4, the illustrated handgun 12 is a conventional semi-automatic handgun having a handle or grip 32 operatively attached to a barrel section 23, a trigger guard 24 and a trigger 25. The barrel portion 23 includes a slide 27 having a top surface 29 while the barrel section 23 includes a lower surface 31 extending from an end of the handgun to the trigger guard 24. Considering FIGS. 1, 2 and 4 together, it can be seen that the holster outer layer 14 has edge portions 20 and 22 that are shaped to overlay top surface 29 and lower surface 31, respectively, including any protuberances from either surface such as a sight, and extend along a major portion of those surfaces of the handgun. The outer layer 14 of the holster also has a side portion 21 from which the edge portions 20, 22 depend and which abuts against one side 30 of the handgun and is molded to fit the contours of the barrel section 23 of handgun 12. The holster middle layer 16 is primarily used to hold the handgun into engagement with the outer layer 14. About twenty percent of the thickness of the handgun is located within the open space between the outer layer and middle layer that is defined by the fasteners 32 and spacers 34. The outer layer 14 covers the remaining eighty percent of the thickness of the handgun that is inserted into the holster. The handgun 12 is maintained in the holster 10 primarily by an interference fit between the trigger guard 24 and an indented portion 26 of the outer layer 14. The indented portion 26 extends partially into the trigger guard 24 and is thermally molded to have a circumferential portion that fits in abutment against an inside rim of the trigger guard. As the handgun 12 is pushed into the holster 10, the outer layer 14 is urged outwardly by contact between the portion 26 and the trigger guard 24. When the leading edge of the trigger guard passes beyond the indented portion 26, the outer layer 14 returns to its normal configuration as the portion 26 snaps into the open area defined by the trigger guard. The middle layer 16 may also be formed to have a raised segment 28 that abuts against an opposite side of the trigger guard 24 so as to urge the trigger guard into engagement with the indented portion 26. It is also possible to form an extending portion of the middle layer 16 in the area of the trigger guard so that the trigger guard is captured from both sides, i.e., from the outer layer 14 and the middle layer 16 if a more positive locking of the handgun in the holster is desired.

Since the illustrative embodiment is intended as an IWB holster, a belt clip 36 is attached to the outer layer 14, preferably using removable sex bolts 38 (also known as a barrel bolt, Chicago screw, post and screw or connector bolt). A compressible washer (not shown) may be placed about the bolt between the clip and holster to provide adjustment for fitting over a belt of the holster user. The fasteners 32 may also be sex bolts and the spacers 34 are preferably of a malleable type so that the spacing between the outer and middle layers can be adjusted by tightening or loosening the fasteners 32. The thickness of the spacers 34 can be varied in conjunction with variations in the height of the edge portions 20 and 22 to change the percentage of coverage of the handgun by the outer layer 14. For example, if it were desired to have 60-40 ratio between the coverage of the handgun and the spacing between the outer and middle layers, the spacers could be made thicker while the sidewalls of the layer 14 defined by the edge portions 20, 22 could be made to extend a lesser amount over the surfaces 29 and 31 of the handgun.

Figure 3:
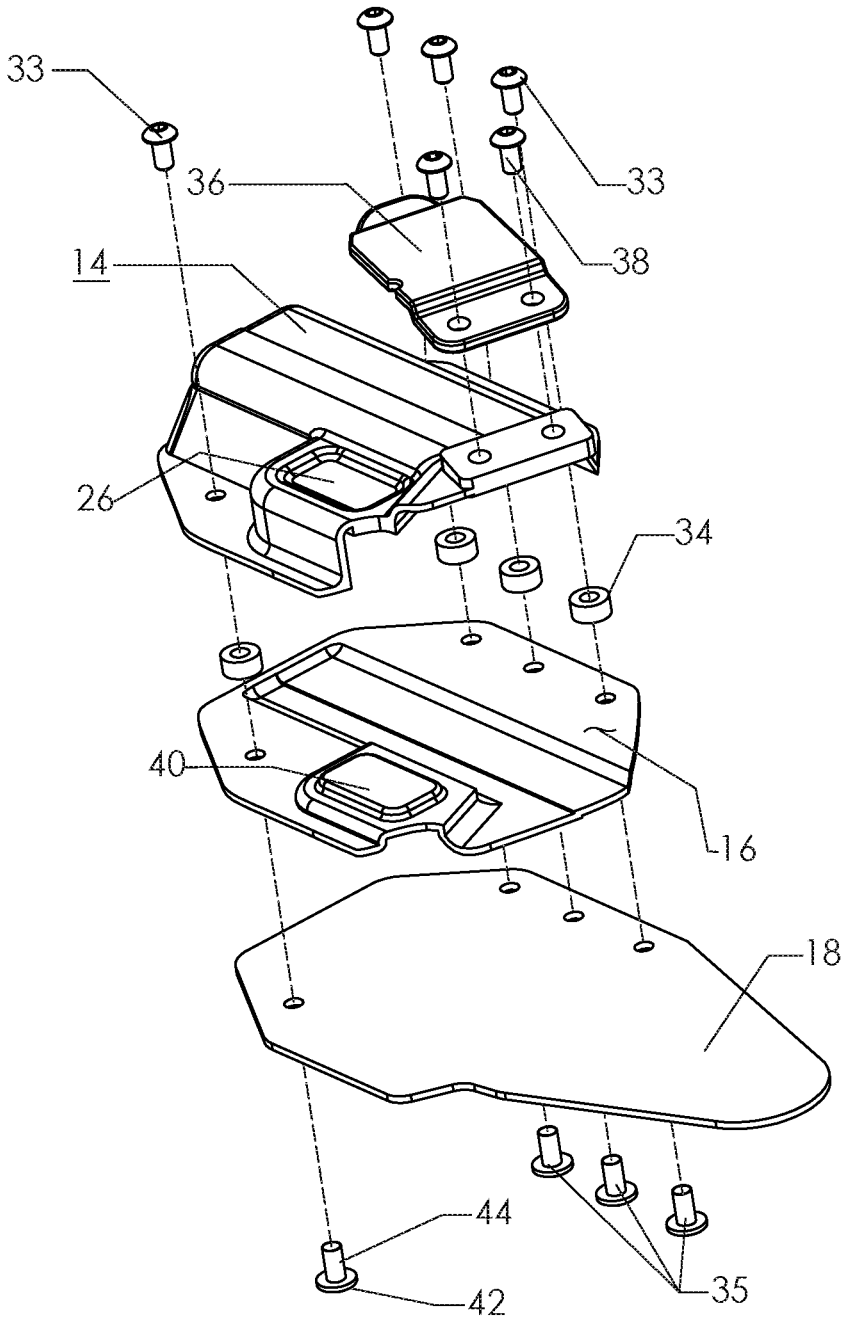
FIG. 3 is an exploded perspective view of the holster of FIG. 1.

FIG. 3 is an exploded view of the holster 10 in one illustrative form. The outer layer 14 is designed to fit about a predetermined extent of the barrel section 23 and slide 27 (see FIG. 4) of the handgun 12 and to extend generally up to the handle portion 32 as is shown in FIGS. 1 and 2. The layer 14 is molded to fit in abutting relationship with the barrel section so that there is a sliding engagement between the layer 14 and barrel section. The indented portion 26 of the layer 14 extends into the trigger guard 24. The portion 26 of layer 14 provides the primary retention of the handgun within the holster.

The middle layer 16 is preferably formed of the same material as the outer layer 14, which in the illustrative embodiment is Kydex brand polymer. The middle layer 16 is generally flat but with molded features that match a side of the gun barrel and trigger guard opposite the side in contact with layer 14. In one form, the layer 16 may include an inwardly formed section 40 extending slightly into the area of the trigger guard 24 to provide additional retention of the handgun within the holster. The middle layer 16 provides a substantially non-deformable surface for supporting the handgun in engagement with the outer layer 14. The inner layer 18 is attached against an outside surface of the middle layer 16 and serves to provide a substantially smooth surface that transitions from the hard middle layer to the user carrying the holster and handgun inside the waistband. It is desirable to use a thick leather pad for the inner layer 18 since the leather layer provides a smooth surface against the user while having the durability to withstand perspiration and to cover any nodules in the middle layer 16.

The three layers of the holster are held together by means of the fasteners 32 (made up of the heads 33 and bases 35) while the compressible spacers 34 establish the spacing between the outer layer 14 and middle layer 16. The heads 33 of the fasteners are preferable screws while the bases 35 have barrel-shaped flanges 42 and protruding bosses 44 that are internally threaded for engagement with the screw heads 33. The flanges 42 provide a bearing surface for holding the inner layer 18 without pulling through the material.

FIG. 4 illustrates the assembled holster 10 with the handgun 12 positioned to be inserted into a pocket 46 defined by an inner surface of the outer layer 14 and an inner surface of the middle layer 16. The lower surface 31 of the barrel section 23 abuts against the inner surface of lower edge portion 22 while the top surface 29 of the barrel section is in sliding contact with some extent of the top edge portion 20 of layer 14. Typically, gun sights (not shown) on the end of the slide may prevent full contact between the top surface 29 and the top edge portion 20.

While the present invention has been described with what is presently considered to be a preferred embodiment, it should be apparent that modifications and variations are possible, all of which fall within the true spirit and scope of the invention. Further, since numerous modifications and changes will readily occur to those skilled in the art, it is not intended to limit the invention to the exact construction shown and described. Accordingly, all suitable modifications and equivalents may be included and considered to fall within the scope of the appended claims.

Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

The invention claimed is:

1. A triple layer hybrid holster for a handgun including a barrel section, a trigger, trigger guard and a handle and being adapted to be worn inside a waistband or belt of a user, the holster comprising:

a pocket for receiving the handgun, the pocket including a first pocket portion and a second pocket portion in compressible space relation with a spacing between the first pocket portion and the second pocket portion;

an outer layer including a shape-retentive moldable plastic material having the first pocket portion molded therein to fit around a bottom side, a top side, and two diametrically opposing sides of the barrel section and molded to fit around a bottom side, a top side, and an exterior side of the trigger guard and including opposing molded flanges perpendicular to the pocket portion, the opposing molded flanges include first apertures for receiving fasteners, the pocket portion:

(i) to extend up to a handle portion of the handgun, (ii) being molded to fit in abutting relationship with the bottom side, the top side and the two diametrically opposing sides of the barrel section so that there is a sliding engagement with the barrel section, and (iii) includes an indented section that extends into the trigger guard of the handgun, the indented section configured to retain the handgun within the pocket;

a middle layer including a non-deformable flat surface with molded features configured to match a side opposite the top side of the barrel section and opposite the top side of the trigger guard, the middle layer:

(i) includes a recess formed in the flat surface to form the second pocket portion to fit the side opposite of the top side of the barrel section, (ii) includes an inwardly formed section formed in the flat surface to extend above a plane of the flat surface, the inwardly formed section configured to extend into the trigger guard to provide additional retention of the handgun within the pocket, and (iii) includes second apertures formed in portions of the flat surface configured to be parallel to the opposing molded flanges of the outer layer, and the second apertures configured to receive the fasteners to fasten to the opposing molded flanges of the outer layer so that the first pocket portion and the second pocket portion align and form the pocket and held in compressible space relation by the fasteners, wherein the outer layer is configured to be urged outwardly as the handgun is pushed into the pocket by contact between the indented section and the trigger guard as a leading edge of the trigger guard passes beyond the indented section, and the outer layer being configured to return to its normal configuration as the indented section snaps into an opening in the trigger guard; and an inner layer attached in abutting relationship to an outer surface of the middle layer, the inner layer being formed of a material having a smooth surface for contacting an adjacent surface of a user when the holster is worn inside the user's waistband or the belt, the inner layer having a length which extends from a bottom end of the pocket to and beyond a top end of the pocket such that the length being configured to extend a distance past a rear sight of the handgun when the barrel of the handgun is held in the bottom end of the pocket while remaining in contact to the adjacent surface of the user due to the position of the rear sight of the handgun next to the inner layer;

bottom edges of the outer layer and the middle layer corresponding to the bottom end of the pocket are flush with a bottom edge of a bottom end of the inner layer; and bottom corner edges of each of the outer layer, middle layer and the inner layer are truncated and flush.

2. The holster of claim 1, wherein the inner layer is formed of leather.

3. The holster of claim 1, wherein the outer layer and the middle layer are each formed from Kydex® polymer.

4. The holster of claim 1, wherein the fasteners comprise a sex bolt.

5. The holster of claim 1, wherein each fastener comprises a spacer, the spacer of said each fastener to set the spacing between the outer layer and the middle layer.

6. The holster of claim 5, wherein said each fastener further comprises a screw, and wherein the outer layer, the middle layer and the inner layer are fastened together by the screws of the fasteners and the spacing between the outer layer and the middle layer is adjustable by tightening or loosening the screws of the fasteners to vary the compression of the spacers.

7. The holster of claim 5, wherein the fasteners comprise screws, each screw comprises a sex bolt having a screw portion extending through the spacer into a flanged barrel portion passing through the inner layer, a flange being on the flanged barrel portion compressing the inner layer against the middle layer.

8. The holster of claim 1, further comprising a flexible clip having first end attached to the pocket and a second end, opposite the first end, configured to fit over and clip onto the waistband or the belt of the user for holding the holster in a selected position inside the waistband or the belt.

* * * * *